United States Patent [19]

Robinson et al.

[11] 4,144,787

[45] Mar. 20, 1979

[54] KEYER CIRCUIT FOR ELECTRONIC ORGAN

[75] Inventors: John W. Robinson; Ralph N. Dietrich, both of Jasper, Ind.

[73] Assignee: Kimball International, Inc., Jasper, Ind.

[21] Appl. No.: 851,069

[22] Filed: Nov. 14, 1977

[51] Int. Cl.[2] ..... G10H 1/00; G10H 5/00

[52] U.S. Cl. ..... 84/1.01; 84/DIG. 23; 84/1.26

[58] Field of Search ..... 84/1.01, 1.03, DIG. 23, 84/1.26; 340/365 R

[56] References Cited

U.S. PATENT DOCUMENTS

| | | | |
|---|---|---|---|
| 3,748,944 | 7/1973 | Schrecongest | 84/DIG. 23 |
| 3,951,028 | 4/1976 | Robinson | 84/1.01 |
| 4,024,786 | 5/1977 | Machanian | 84/DIG. 23 |
| 4,055,103 | 10/1977 | Machanian | 84/1.01 |

*Primary Examiner*—Robert K. Schaefer
*Assistant Examiner*—William L. Feeney
*Attorney, Agent, or Firm*—Albert L. Jeffers; John F. Hoffman

[57] ABSTRACT

A keyer circuit for electronic organs and the like in which a single main keyer chip is formed by utilizing large scale integrated MOS technology with the chip adapted for use with organs having different information supplied to the multiplexing system. The chip provides output information to drive discrete circuitry and also has the necessary input for normal multiplexing operation of an electronic organ. The chip according to the present invention provides internal multiplexing for simple organs and standard external multiplexing for more complex organs.

28 Claims, 5 Drawing Figures

KEYER CIRCUIT FOR ELECTRONIC ORGAN

BACKGROUND OF THE INVENTION

The present invention relates to a keyer system for electronic organs and, in particular, a keyer system having wide adaptability to both simple and more complex organs and provides the capability of being integrated with other organ circuitry, especially through MOS techniques.

In the electronic organ art, keying of tones is always an extremely important part of the operation of the organ. The keying arrangements and circuitry pertaining thereto can become relatively expensive and, where different keying systems are used for organs of different size, inventory of parts can become an expensive and troublesome matter.

The present invention is concerned with a keyer system or circuit having relatively wide adaptability in respect of electronic organs and, therefore, greatly reducing the problems and expense attendant to maintaining the necessary inventories. More particularly still, the present invention proposes a widely adaptable keyer circuit for electronic organs which takes the form of a single monolithic large scale integrated chip employing MOS technology.

SUMMARY OF THE INVENTION

According to the present invention, a keyer circuit which lends itself to large scale integrated MOS technology is provided in which a principal component of the keyer circuitry is a dual use chip that can be connected in circuit with a conventional multiplexed organ circuit or which can be connected in circuit with a nonmultiplexed organ with the interposition of multiplexing units between the organ manual and the chip of the present invention.

The chip is provided with tone signal inputs which are divided down within the chip and supplied to a bank of keyers which are connected to keyer outputs formed on the chip. The keyers are activated by way of a circuit portion including controllable attack and decay and which circuit portion is supplied from a latch that is, in turn, supplied from a shift register to which incoming data is supplied.

The chip comprises a plurality of data inputs which can receive data sequentially. The data inputs can also be adjusted so that only one receives data as from a conventional organ multiplexer.

The gating and data input selection and the generation of various clock commands is accomplished within the chip while the chip is also provided with means for receiving an external latch command when data is fed thereto from a conventional organ multiplexer.

Specifically, the present invention contemplates a keyer system in an electronic organ having a plurality of playing keys forming a keyboard and tone generator means for producing a plurality of tone signals. The keyer system comprises a plurality of keyer means for placing selected ones of the tone signals on its output terminals, data input means including a plurality of data input terminals for receiving a plurality of streams of time division multiplexed serial binary data representative of depressed keys on the keyboard and for combining the input data streams into a single internal time division multiplexed serial binary data stream, means for demultiplexing the internal data stream and for controlling the keyer means to connect to their output terminals tone signals corresponding to depressed keys on the keyboard, clock means for producing a plurality of time sequential clock pulses which are connected to the clock input of the demultiplexing means, counter means clocked by the clock means for producing external time division multiplex scanning signals and an internal latch command signal synchronized with the multiplexer scanning signals, an external latch input terminal, gating means for alternatively connecting the internal latch command signal to the demultiplexing means latch input when the keyer system is in a first mode of operation and connecting the external latch input terminal to the latching input of the demultiplexing means when the keyer system is in a second mode of operation, means for enabling all of the data input terminals to receive data when the keyer system is in its first mode of operation and for enabling only one of the input terminals to receive data when the keyer system is in its second mode of operation, and mode select terminal means operatively connected to the gating means and the means for enabling for placing the keyer system alternatively in its first or second modes of operation.

An object of the present invention is the provision of a relatively inexpensive but versatile chip free from audio pop or thump for incorporation in the keyer circuitry of an electronic organ.

Another object is the provision of a chip of the nature referred to which can be incorporated in a conventional multiplexed organ or which can be incorporated in the circuitry of a non-multiplexed organ.

BRIEF DESCRIPTION OF THE DRAWINGS

The exact nature of the present invention will become more clearly apparent upon reference to the following detailed specification taken in connection with the accompanying drawings in which:

FIG. 5 is a block diagram of an alternative output circuit for the keyer chip according to the present invention.

DETAILED DESCRIPTION OF THE INVENTION

Figure 1:
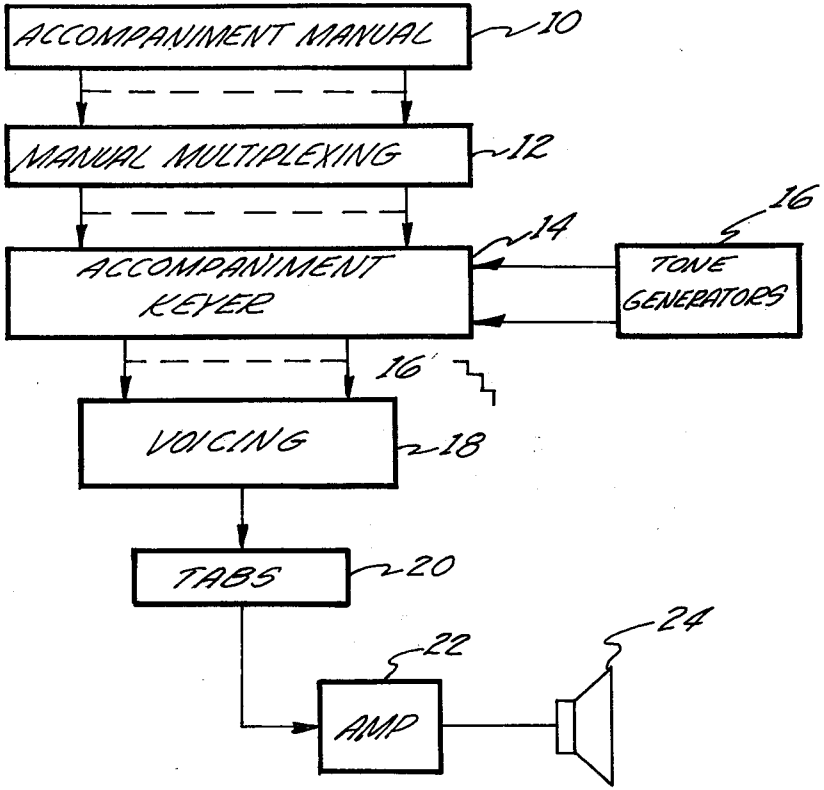
FIG. 1 is a block diagram of typical organ circuitry showing the keyer chip of the present invention incorporated therein.

Referring to the drawings somewhat more in detail, in FIG. 1, reference numeral 10 represents the accompaniment manual of an electronic organ and connected thereto is a multiplexing system 12 of a known type which supplies outputs to the keyer chip 14 according to the present invention. Keyer chip 14 is provided with tone signals from a tone generator 16 and supplies 16 foot staircase waves to voicing circuit means 18 in conformity with the respective keys of chip 14 that have been activated. Tabs 20 control the signal flow through voicing 18 and the output from tabs 20 passes through amplifier 22 to speaker 24.

Figure 2:
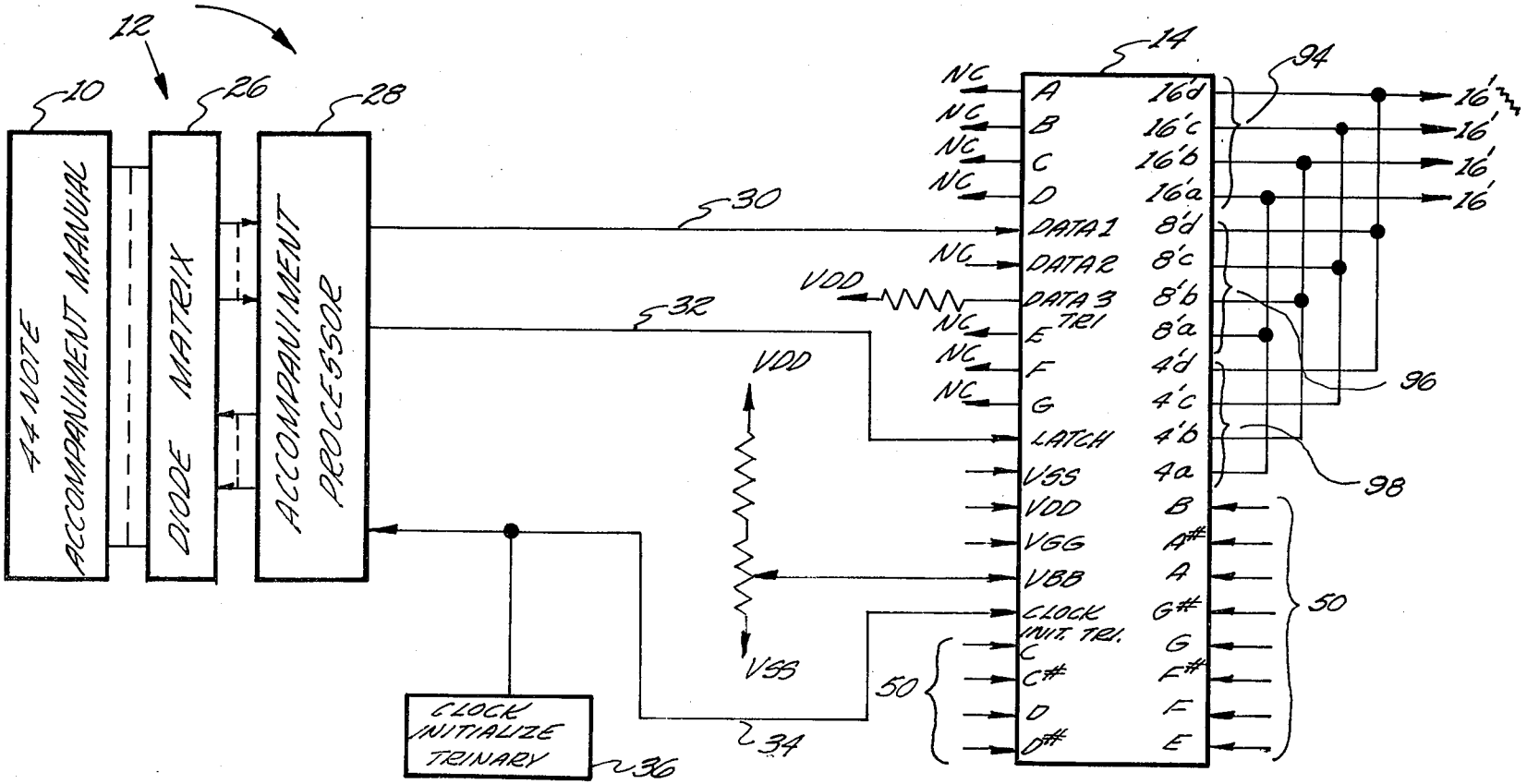
FIG. 2 is another block diagram showing the keyer chip according to the present invention incorporated in a multiplexed organ circuit.
Figure 3:
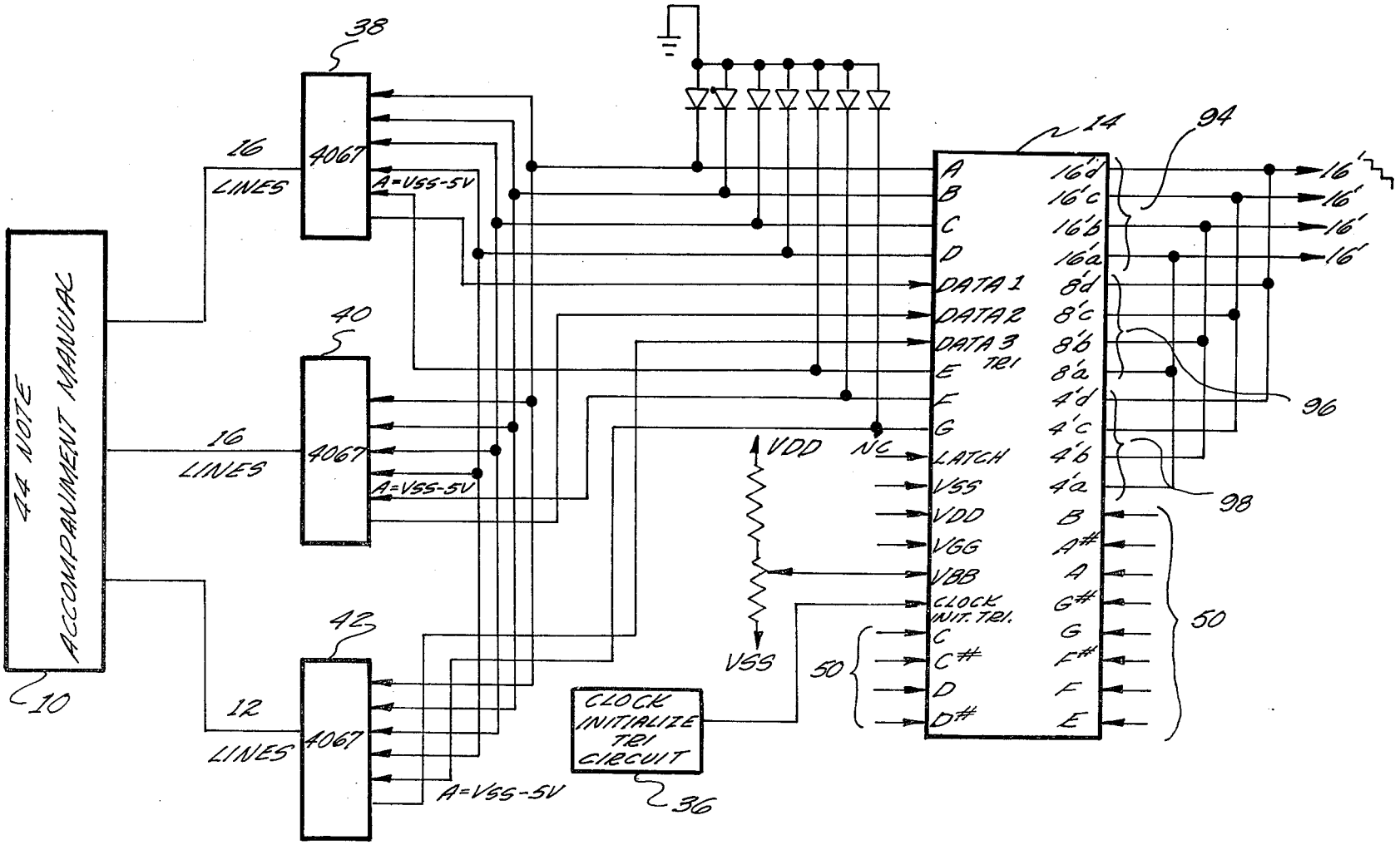

In FIG. 2, a somewhat more detailed block diagram is illustrated in which the accompaniment manual 10 referred to will be seen to be represented as a forty-four note manual which is connected through the time division multiplexing system 12 referred to in FIG. 1 with the chip 14. Multiplexing system 12 will be seen to consist of a diode matrix 26 and processor circuitry 28. Chip 14 is a single monolithic large scale integrated chip having forty pins to provide input and output.

Chip 14, it will be noted in FIG. 2, receives tone signals from a master oscillator via the tone signal input pins 50 marked C through B and provides square wave outputs on pins 94, 96 and 98 in accordance with tones selected by the keyers. The chip, furthermore, has the output from the organ multiplexer supplied to an input pin marked Data 1 by a wire 30 and is supplied with latch commands to a latch input pin by a wire 32 from the organ multiplexer while a wire 34 supplies an initiating signal to a clock input pin on chip 14 and a terminal on the organ multiplexer and is, furthermore, connected with a clock-initialize source 36 which will be explained more fully hereinafter. In FIG. 2, it will be seen that the connections between the organ multiplexer and the chip 14 are relatively simple and easy to accomplish.

Figure 3:
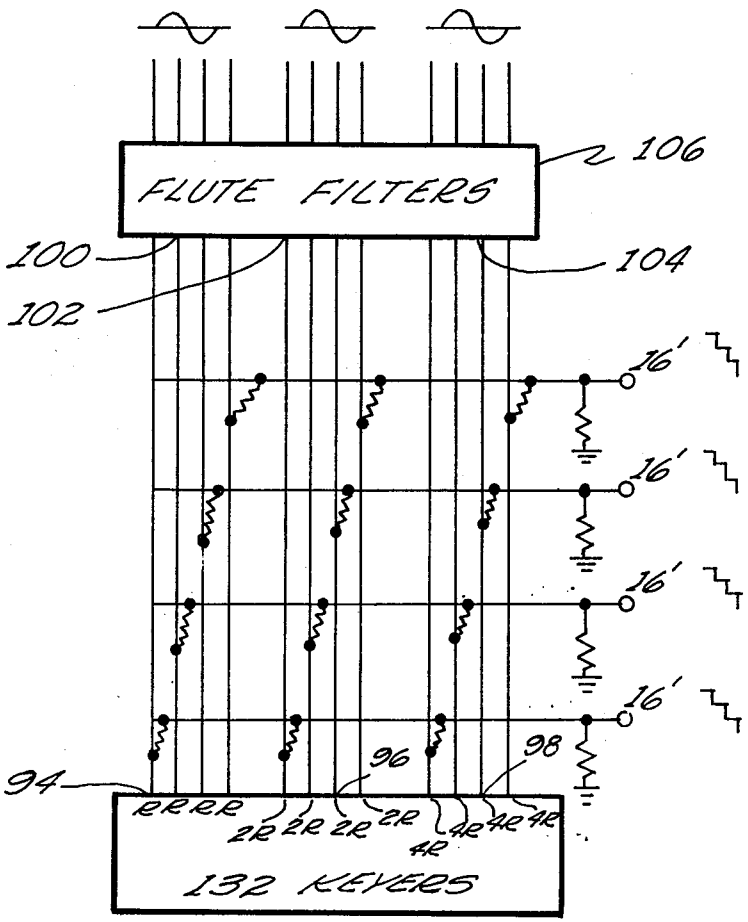
FIG. 3 is a view like FIG. 2 but shows the chip according to the present invention incorporated in a nonmultiplexed organ circuit.

FIG. 3 shows the chip 14 incorporated in a non-multiplexed organ system. The accompaniment manual 10, which again may be a forty-four note manual, has the switches operated by the keys thereof connected to the input sides of 4067 time division multiplexers 38, 40 and 42. These multiplexers are supplied by the clock or scanning outputs of chip 14 which are identified at pins A, B, C, D, E, F and G on the chip. These counter outputs are not employed in the circuit arrangement of FIG. 2, and in FIG. 2 are, as shown, not connected.

In FIG. 3, the outputs of the multiplexers 38, 40 and 42 are connected to the Data 1, Data 2 and Data 3 input pins of chip 14 as shown and supply data to the data inputs sequentially. The data internally in the chip is demltiplexed and supplied to keyers with the latch command for the demultiplexer being derived internally in the chip.

The component 36 in FIG. 3 is connected to the clock input of chip 14 as in the case of the FIG. 2 circuit but is not connected back to the organ multiplexing system, which system, instead, derives control signals from a clock-initialize 36.

Figure 4:
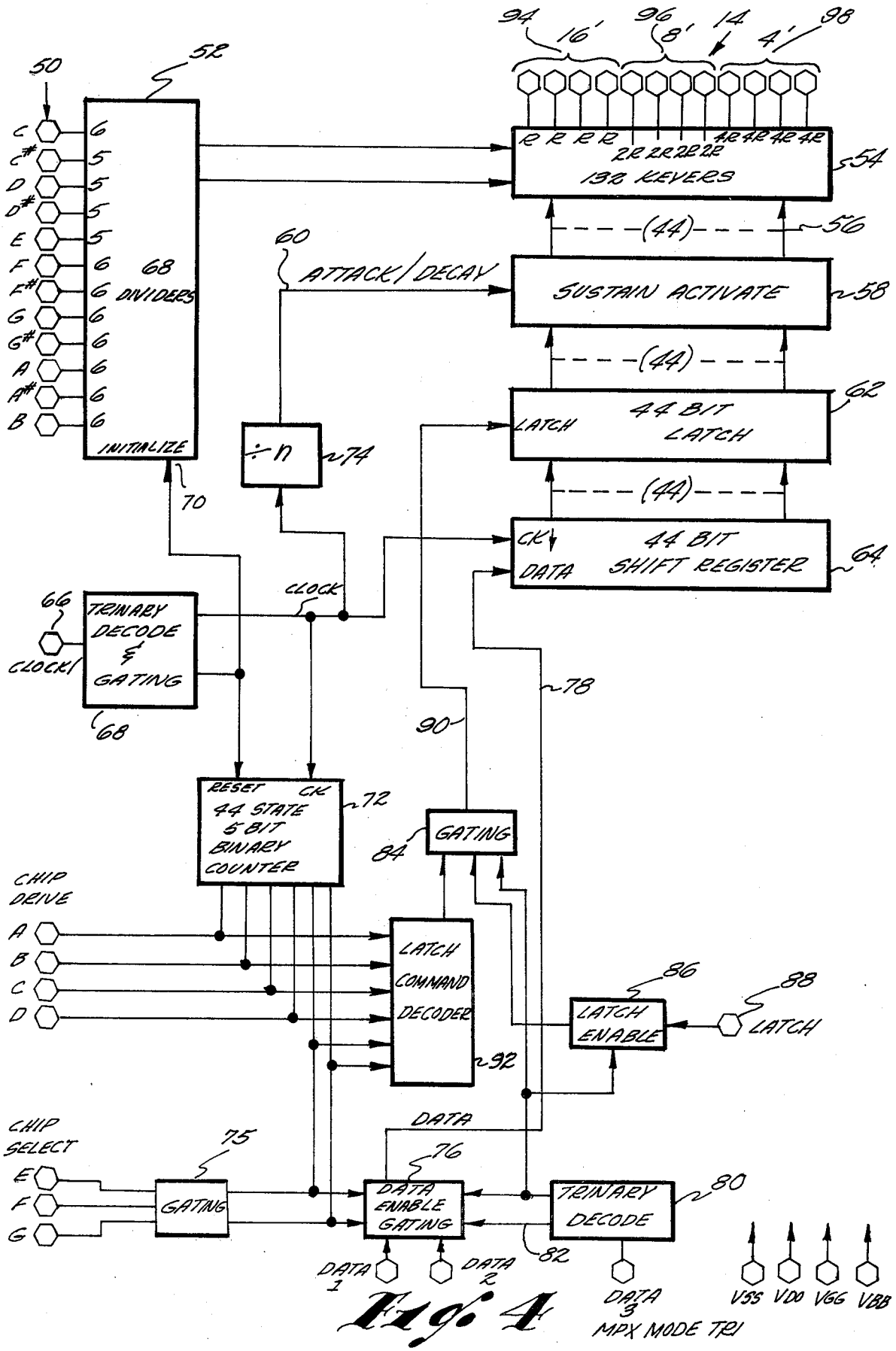
FIG. 4 is a MOS detailed block diagram of the chip according to the present invention.

Turning now to FIG. 4, the chip 14 is shown somewhat more in detail, and will be seen to comprise the tone generator input pins previously referred to and indicated at 50. The tone generator inputs are supplied to a bank of dividers 52 to provide the range of pitches necessary to supply the 132 keyers in the keyer block 54.

The keyers in block 54 are operable for keying 16, 8 and 4 foot tones and a group of 68 dividers in block 52 will, together with the tone signal inputs, provide tone signals to the keyers in block 54. The 132 keyers in block 54 are actuated in groups of three by the forty-four inputs at 56 which are derived from the envelope control circuitry 58 which is disclosed in detail in copending application Ser. No. 736,256, filed Oct. 27, 1976. Essentially, the circuitry at 58 comprises a charge exchange system under the control of a source of clock pulses 60 by means of which the attack and decay of a signal actuating signal can be controlled. The circuit component at 58 is supplied by the forty-four outputs of latch 62 which, in turn, are supplied by the forty-four outputs of shift register 64.

The clocking input of the chip previously referred to indicated at 66 is connected through a component 68 which accomplishes trinary decoding and gating. One output of component 68 is supplied at 70 to the divider group 52 to initialize operation thereof and is also connected to the reset terminal of a forty-four state six bit binary counter 72. Another output of component 68 is divided down at 74 to provide the clocking input to component 58 and is also connected to the clocking input of shift register 64 and is also connected to the input of counter 72.

The counter 72 directly supplies the output terminals A, B, C and D previously referred to and supplies outputs E, F and G by way of gating 75. The outputs E, F and G will be seen in FIG. 3 to enable multiplexers 38, 40 and 42 sequentially and repetitively. The outputs from counter 72, connected to gating 75, are the most significant outputs so that, by way of gating 75, the output terminals E, F and G can be caused to become sequentially effective repeatedly.

The inputs to gating 75 are also connected to data enable gating 76 which is operable for controlling the supply of data via data supply line 78 to shift register 64 from data inputs 1, 2 and 3 so that the data inputs will receive data during the time that the multiplexers pertaining thereto are supplying data.

The Data 3 input is connected through a trinary decode component 80 which has one output 82 connected to the data enable gating 76 and another output connected to gating 76 and also connected to a further gating component 84 and to a latch enable gate 86. The latch enable gate 86 is adapted for receiving a latch command via the latch terminal 88 to which wire 32 is connected in the FIG. 2 circuitry.

When the chip is used in the FIG. 2 configuration, all data enters through the Data 1 input and the command controlling latch 62 is supplied by wire 32 to terminal 88.

When the latch gating at 86 is adjusted to enable a latch command supplied to terminal 88, gating 84 is also effective for passing the latch command to connection 90 leading to the latch terminal of latch 62.

When the latch command is generated internally of the chip, counter 72 via decoder 92 is operable to supply a command through gating 84 to connection 90 and, at this time, any latch command from terminal 88 is gated off the gate 86.

From the foregoing, it will be seen that the keying system disclosed lends itself to different modes of handling multiplexed information. The chip provides data for deriving discrete circuitry as well as supplying necessary inputs for normal multiplexing systems.

The keying system is adaptable for simple organs using the system arrangement shown in FIG. 3 and can be employed for more complex organs using the system as shown substantially in FIG. 2.

The use of a chip according to the present invention thus represents economy of circuitry and permits reduction of inventory.

It will be noted in FIGS. 2, 3 and 4 that the keyer component 54 has a plurality of keyer outputs, namely a 16 foot output, an 8 foot output which is one-half the frequency of the 16 foot output, and a 4 foot output, which is one-half the frequency of the 8 foot output, as indicated by the brackets thereon in FIG. 4. These keyer outputs are advantageously interconnected externally of the chip as shown in FIGS. 2 and 3 to provide for the harmonic rich staircase outputs referred to.

In interconnecting the keyers, as shown in FIGS. 2 and 3, for example, the keyers may be interconnected in a known manner via resistors which will provide for the proper levels of the respective keyers. For example, in FIG. 4, the 16 foot keyer outputs will be seen to be marked with an R while the 8 foot keyer outputs are marked 2R (indicating an amplitude which is one-half that of the 16 foot output) and the 4 foot keyer outputs are marked 4R (indicating an amplitude which is one-fourth that of the 16 foot output). Thus, when a 16 foot keyer output is connected with an 8 foot and a 4 foot keyer output, the resistance associated with an 8 foot keyer is twice that associated with a 16 keyer while that associated with a 4 foot keyer is four times that associated with a 16 foot keyer. Incorporation of resistances in this known manner produces a staircase output wave with steps at appropriate levels.

Rather than connecting the keyer outputs to form 16 foot staircase signals as shown in FIGS. 2 and 3, the square wave outputs can be filtered to form flute tones as shown in FIG. 5. Since a square wave contains the fundamental plus odd harmonics, by filtering the odd harmonics, an essentially pure sinusoidal flute tone will result.

The 16 foot, 8 foot and 4 foot keyer outputs 94, 96 and 98 are connected to the inputs 100, 102 and 104 of flute filters represented by block 106. Filters 106 filter out all odd harmonics to produce the respective fundamentals which are pure sinusoidals. Interconnection of the keyer outputs in the same manner as in FIGS. 2 and 3 results in the harmonic rich 16 foot staircase signals.

While this invention has been described as having a preferred design, it will be understood that it is capable of further modification. This application is, therefore, intended to cover any variations, uses, or adaptations of the invention following the general principles thereof which fall within the limits of the appended claims.

What is claimed is:

1. In an electronic organ having a plurality of playing keys forming a keyboard and tone generator means for producing a plurality of tone signals, a keyer system comprising:

a plurality of keyer means including tone output terminals for placing selected ones of said tone signals on said output terminals, data input means including a plurality of data input terminals for receiving a plurality of streams of time division multiplexed serial binary data representative of depressed keys on said keyboard and for combining said input data streams into a single internal time division multiplexed serial binary data stream, means for demultiplexing said internal data stream and for controlling said keyer means to connect to said output terminals tone signals corresponding to depressed keys on said keyboard, said demultiplexing means including a clock input and a latching input, clock means for producing a plurality of time sequential clock pulses, said clock means being operatively connected to said demultiplexing means clock input, counter means clocked by said clock means for producing external time division multiplexing scanning signals and an internal latch command signal synchronized with said scanning signals, an external latch input terminal, gating means for alternatively connecting said internal latch command signal to said demultiplexing means latching input when said keyer system is in a first mode of operation and said external latch input terminal to said demultiplexing means latching input when said keyer system is in a second mode of operation, means for enabling all of said data input terminals to receive data when said keyer system is in said first mode of operation and for enabling only one of said input terminals to receive data when said keyer system is in said second mode of operation, and mode select terminal means operatively connected to said gating means and said means for enabling for placing said keyer system alternatively in said first or second modes of operation.

2. The organ or claim 1 including a plurality of multiplexer means for time division multiplexing respective portions of said keyboard each having scanning inputs connected to receive said external scanning signals and a multiplex data output terminal connected respectively to said data input terminals, and wherein said mode select terminal means is operable to place said keyer system in said first mode of operation.

3. The organ of claim 2 wherein said counter means produces an output signal comprising a series of first binary words for simultaneously scanning said multiplexer means and a series of second binary words for scanning said multiplexer means in succession.

4. The organ of claim 3 wherein said counter means includes latch decoder means connected to receive said counter means output signal and to generate said internal latch command signal in response to said counter output signal.

5. The organ of claim 1 wherein said clock means comprises a trinary output clock-initialize circuit and including a trinary decoder connected to said clock-initialize circuit means having a first output to reset said counter means and a second clock output connected to said demultiplexing means clock input.

6. The organ of claim 1 wherein said mode select terminal means is connected to one of said data input terminals and includes trinary decoder means for generating a signal operative to place said keyer system in either said first or second modes.

7. The organ of claim 1 wherein said demultiplexing means comprises a shift register having a clock input operatively connected to said clock means and a data input connected to said internal data stream, and a latch interposed between said shift register and said keyer means, said latch including said latch input.

8. The organ of claim 1 wherein said tone signals are square wave pulses, said keyer means includes means for placing 16 foot, 8 foot and 4 foot square wave pulses corresponding to said tone signals on said keyer output terminals, and including means interconnecting said keyer output terminals to convert the square wave pulses to staircase signals.

9. The organ of claim 8 including flute filter means connected to said keyer output terminals for filtering out all odd harmonics from said square wave pulses to thereby produce fundamental tones.

10. The organ of claim 1 including flute filter means connected to said keyer output terminals for filtering out all odd harmonics from said square wave pulses to thereby produce fundamental tones.

11. The organ of claim 10 wherein said keyer means includes means for placing 16 foot, 8 foot and 4 foot square wave pulses on the output terminals thereof.

12. The organ of claim 1 including means for time division multiplexing said keyboard to produce a single external data stream containing key down pulses in respective time slots, said external data stream being connected to one of said data input terminals, and wherein said mode select terminal means is operable to place said keyer system in said second mode of operation.

13. The organ of claim 12 wherein said means for multiplexing places an external latching signal on said external latch terminal, and said clock means is operatively connected to said means for multiplexing.

14. The organ of claim 1 wherein said keyer means includes means for placing first square wave pulses and second square wave pulses on the output terminals thereof, the amplitude of said first pulses being substantially twice the amplitude of said second pulses.

15. In an electronic organ having a plurality of playing keys forming a keyboard and tone generator means for producing a plurality of tone signals, a keyer circuit in the form of a single integrated circuit having a plurality of external input and output pins comprising:

a plurality of keyer means, including external tone output pins, for placing selected ones of said tone signals on said output pins, data input means for receiving a plurality of streams of time division multiplexed serial binary data representative of depressed keys on said keyboard on a plurality of external data input pins and for combining said input data streams into a single internal time division multiplexed serial binary data stream, means for demultiplexing said internal data stream and for controlling said keyer means to connect to said output pins those tone signals corresponding to depressed keys on said keyboard, said demultiplexing means including a clock input and a latching input, clock means external to said chip for producing a plurality of time sequential clock pulses, said clock means being connected to said demultiplexing means clock input, counter means clocked by said clock means for producing external time division multiplexer scanning signals on at least one external scan pin and for producing an internal latch command signal synchronized with said multiplexer scanning signals, an external latch input pin, gating means for alternatively connecting said internal latch command signal to said demultiplexing means latching input when said keyer system is in a first mode of operation and connecting said latch input terminal to said demultiplexing means latching input when said keyer system is in a second mode of operation, means for enabling all of said data input terminals to receive data when said keyer system is in said first mode of operation and for enabling only one of said input terminals to receive data when said keyer system is in said second mode of operation, and mode select means operatively connected to said gating means and said means for placing said keyer system alternatively in said first or second modes of operation.

16. The organ of claim 15 wherein said counter means includes a plurality of external scan pins, and including a plurality of multiplexer means for time division multiplexing said keyboard to produce a plurality of external data streams containing key down pulses in respective time slots, said data streams being connected respectively to said data input pins, said multiplexer means each including scanning input terminals connected to said external scan pins, and said mode select means is operable to place said keyer system in said first mode.

17. The organ of claim 15 including means for time division multiplexing said keyboard to produce a single external data stream containing key down pulses in respective time slots, said external data stream being connected to one of said external data pins and wherein said mode select means is operable to place said keyer system in said second mode of operation.

18. The organ of claim 15 wherein said clock means comprises a trinary output clock-initialize circuit and including a trinary decoder internal to said chip, and having a clock input pin on said chip, said trinary decoder having a first output means operable to reset said counter means and a second output operatively connected to said demultiplexing means clock input.

19. The organ of claim 15 wherein said mode select means has an input connected to one of said data input pins and includes trinary decode means for generating a signal operative to place said keyer system in either said first or second modes of operation.

20. The organ of claim 19 wherein control signal means operable to render said mode select means operable to place said keyer system in said second mode of operation is present on said one of said data pins.

21. The organ of claim 15 wherein said tone signals are square waves and said keyer means includes means for placing 16 foot, 8 foot and 4 foot square wave signals corresponding to said tone signals on said output pins.

22. A keyer circuit for an electronic organ, said keyer circuit being in the form of a single integrated circuit chip having external input and output pins and comprising:

a plurality of keyer means providing selected tone signals on certain ones of said chip output pins, counter means for producing external multiplexer scanning signals on certain other ones of said chip output pins, a plurality of said pins forming data input pins, means for combining time division multiplexed data on said data input pins into a single stream of time division multiplexed data, one of said input pins forming a clock input pin adapted to receive clock input signals, means synchronized with said counter means and said clock input signals for demultiplexing said single stream of data and for controlling said keyers in response to said single data stream to provide selected tones on said certain ones of said chip pins, one of said chip input pins forming a latch input pin adapted to receive latch input signals, said mode select means having an input terminal external to said chip for overriding said counter means and synchronizing said demultiplexing means with said latch input signals when a selected control signal is present on said mode select means input terminal.

23. The keyer circuit of claim 22 wherein said mode select means includes means for disabling all but one of said data input pins when said selected control signal is present on said mode select means input terminal.

24. The keyer circuit of claim 23 wherein said tone signals are 16 foot, 8 foot and 4 foot square wave pulses.

25. The keyer circuit of claim 24 including means interconnecting said certain ones of said pins to produce staircase signals.

26. The keyer circuit of claim 22 wherein:

said tone signals include first square wave pulses and second square wave pulses, the amplitude of said second pulses is approximately one-half the amplitude of said first pulses, and the frequency of said second pulses is approximately twice the frequency of said first pulses.

27. The keyer circuit of claim 26 wherein: said tone signals include third square wave pulses, the amplitude of said third pulses is approximately one-fourth the amplitude of said first pulses, and the frequency of said third pulses is approximately four times the frequency of said first pulses.

28. The keyer circuit of claim 27 including means interconnecting said certain ones of said pins to produce staircase signals.

* * * * *

UNITED STATES PATENT AND TRADEMARK OFFICE

CERTIFICATE OF CORRECTION

PATENT NO. : 4,144,787

DATED : March 20, 1979

INVENTOR(S) : John W. Robinson and Ralph N. Dietrich

It is certified that error appears in the above-identified patent and that said Letters Patent are hereby corrected as shown below:

Col. 5, line 10, after "16" insert -- foot --.

Claim 2, Col. 6, line 13, "or" should be -- of --.

Claim 22, Col.8, line 51, "said" should be -- and --.

Signed and Sealed this

*Seventeenth* Day of *July 1979*

[SEAL]

*Attest:*

LUTRELLE F. PARKER

*Attesting Officer* *Acting Commissioner of Patents and Trademarks*